US006584701B1

(12) United States Patent
Brown et al.

(10) Patent No.: US 6,584,701 B1
(45) Date of Patent: Jul. 1, 2003

(54) SYSTEM, APPARATUS, AND METHOD FOR REDUCING MOISTURE CONTENT OF PARTICULATE MATERIAL

(75) Inventors: Robert W. Brown, Baltimore, MD (US); John W. Doub, Jr., Queenstown, MD (US)

(73) Assignee: Novatec, Inc., Baltimore, MD (US)

( * ) Notice: Subject to any disclaimer, the term of this patent is extended or adjusted under 35 U.S.C. 154(b) by 0 days.

(21) Appl. No.: 10/031,228

(22) PCT Filed: Jun. 14, 2001

(86) PCT No.: PCT/US01/18945

§ 371 (c)(1),
(2), (4) Date: Jan. 17, 2002

(87) PCT Pub. No.: WO01/98720

PCT Pub. Date: Dec. 27, 2001

Related U.S. Application Data

(60) Provisional application No. 60/212,052, filed on Jun. 16, 2000.

(51) Int. Cl.[7] ..... F26B 17/12

(52) U.S. Cl. ..... 34/169; 34/576; 34/177

(58) Field of Search ..... 34/576, 168, 169, 34/177, 165

(56) References Cited

U.S. PATENT DOCUMENTS

| | | | | |
|---|---|---|---|---|
| 3,621,585 A | | 11/1971 | Robertson | |
| 4,259,158 A | | 3/1981 | Weber et al. | |
| 4,325,192 A | | 4/1982 | Larsen et al. | |
| 4,523,388 A | | 6/1985 | Cuel | |
| 4,568,258 A | | 2/1986 | Henderson | |
| 4,725,337 A | | 2/1988 | Greene | |
| 4,783,201 A | | 11/1988 | Rice et al. | |
| 5,118,327 A | | 6/1992 | Nelson et al. | |
| 5,131,929 A | | 7/1992 | Brockmann et al. | |
| 5,255,634 A | * | 10/1993 | Mansour | 122/4 D |
| 5,433,019 A | | 7/1995 | Fu et al. | |
| 5,566,468 A | | 10/1996 | Graeff | |
| 5,592,752 A | | 1/1997 | Fu et al. | |
| 5,636,449 A | | 6/1997 | Gaddis et al. | |
| 5,842,289 A | | 12/1998 | Chandran et al. | |
| 5,896,675 A | | 4/1999 | Holler et al. | |
| 5,961,692 A | | 10/1999 | Collins | |
| 6,158,147 A | | 12/2000 | Smith et al. | |
| 6,167,638 B1 | | 1/2001 | Vavro et al. | |
| 6,199,294 B1 | * | 3/2001 | Becker | 34/80 |

* cited by examiner

*Primary Examiner*—Ira S. Lazarus
*Assistant Examiner*—Kathryn S. O'Malley
(74) *Attorney, Agent, or Firm*—Niles & Stockbridge P.C.

(57) ABSTRACT

A system for drying particulate material in a drying hopper (DH) has a plurality of gas flow paths, one (FP1) of which extends from a compressed gas inlet (16) to a first sub-system (SS1) that includes a membrane dryer(MD) and a heater (EH'), whereby dried and heated gas is supplied to a lower portion (36) of the hopper, and another (FP2) of which extends from the inlet (16) to a second sub-system (SS2) that includes a mixing device (30) and a heater (EH). The mixing device uses compressed gas to induce a flow of gas from the hopper and mixes the compressed gas with gas withdrawn from the hopper. The mixed gases are heated and supplied to a second portion (34) of the hopper.

10 Claims, 1 Drawing Sheet

SYSTEM, APPARATUS, AND METHOD FOR REDUCING MOISTURE CONTENT OF PARTICULATE MATERIAL

CROSS REFERENCE TO RELATED APPLICATION

This application claims the benefit of provisional application No. 60/212,052 filed Jun. 16, 2000, incorporated herein by reference.

BACKGROUND OF THE INVENTION

This invention relates to systems, apparatus and methods for drying material in a drying chamber, such as a hopper through which solid bulk material to be dried is passed. The invention is more particularly concerned with systems, apparatus, and methods for reducing the moisture content of solid particulate or pelletized material, such as plastic pellets supplied to industrial molding and extrusion machinery, food products, animal feed, chemicals or pharmaceuticals.

Conventional systems for drying particulate materials such as plastic pellets have relied upon the use of desiccants to remove moisture from a stream of drying air passed through a bed of the material. The desiccant, which is typically a molecular-sieve type material (e.g., zeolite), captures moisture from the air stream to produce very low dew point air which is in turn supplied to the material bed to dry the material to a desired moisture content level. In a typical system, the desiccant is situated in a unit disposed downstream from the particulate bed in a closed loop, and the dehumidified air from the desiccant unit is recirculated to the bed by a blower. A heater situated between the desiccant unit and the material bed heats the low dew point air to a desired drying temperature for supply to the bed.

The recommended dew point of air for drying plastic pellets is ordinarily below 0° F., and typically in a range of about −20° F. to about −50° F. (or lower). Desiccant type drying systems can readily provide such low dew point air and have become quite popular over the years.

Notwithstanding their popularity, desiccant type drying systems have significant drawbacks. These arise primarily from the fact that desiccant materials must be regenerated periodically in order to maintain their effectiveness. Desiccants dehumidify by adsorption. When used over a period of time, a desiccant material will become loaded with water and lose its effectiveness as a drying medium. To restore its effectiveness, the desiccant material is regenerated from time to time, usually by flowing a heated air stream through the desiccant unit to drive off the adsorbed moisture. This requires that the desiccant unit be taken off-line, interrupting the drying process, or that the drying system include a second desiccant unit used alternately with the first desiccant unit, or which is operated such that its on-line time at least overlaps the regeneration cycle of the first unit.

In systems using a single desiccant unit, the down time associated with the desiccant regeneration cycle results in reduced material throughput. Systems employing multiple desiccant units can avoid this problem, but they are more expensive due to the need to provide additional desiccant units and correspondingly more complex system controls.

SUMMARY OP THE INVENTION

The present invention avoids the drawbacks of conventional desiccant type drying systems.

In a preferred embodiment, a system of the invention has two sub-systems, a first of which includes a dryer and a heater to supply dried and heated gas to a first portion of a drying chamber, and a second of which mixes gas from an inlet with gas withdrawn from the drying chamber, heats the mixed gases, and supplies the mixed gases to a second portion of the drying chamber.

In a preferred embodiment, the dryer is a so-called membrane dryer that substantially maintains its drying capacity under continuous use, without the need for regeneration. For use in drying particulate materials such as plastic pellets, the dryer may preferably be constructed to produce an output stream of air (or other suitable drying gas) having a dew point not exceeding 0° F., preferably not exceeding −20° F. and, more preferably, as low as at least about −40° F. The invention is not restricted to the use of membrane dryers, but such dryers are advantageous from the standpoint of cost and simplicity of installation and operation. They can also achieve low dew points consistent with the preferences noted above.

BRIEF DESCRIPTION OF THE DRAWING

The invention will be more fully appreciated from the accompanying description of a preferred embodiment taken in conjunction with the accompanying drawing, which is a schematic diagram illustrating a preferred embodiment.

DESCRIPTION OF THE PREFERRED EMBODIMENT

Figure 1:
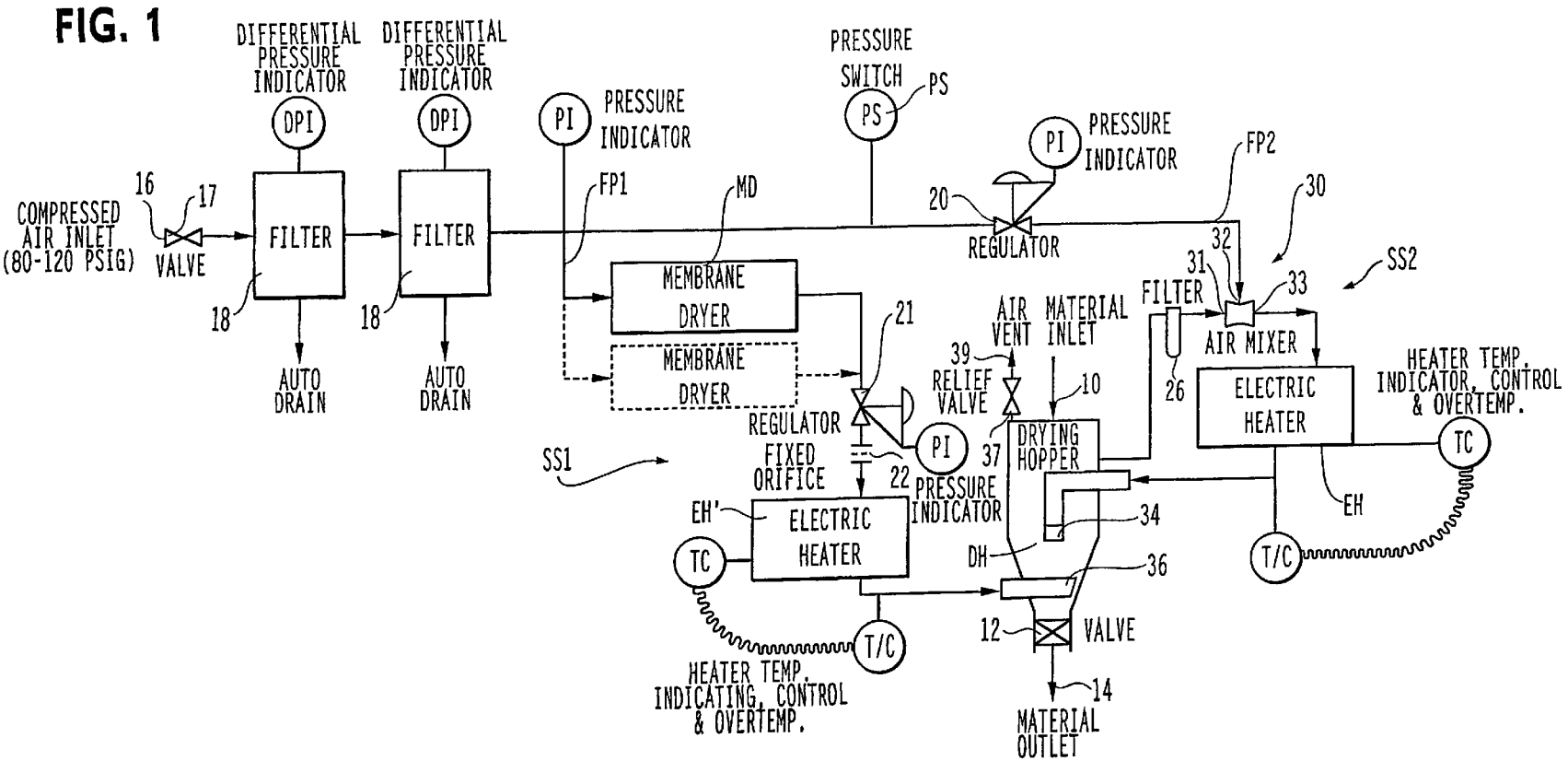

The system shown in the drawing is designed such that drying air (or gas) supplied to a bed of particulate material, such as plastic pellets, is passed through the material bed contained in a drying chamber, such as a drying hopper DH which receives the material via an inlet 10 at the top. The material of the bed moves slowly downward through the hopper, passes through a valve 12, and is discharged via an outlet 14. The residence time of the material in the hopper will, of course, depend upon the particular material being dried and the desired level of dryness to be achieved. For plastic pellets, typical residence time in the hopper may be approximately four hours.

As the particulate material moves downwardly through the hopper, its moisture content is reduced by a flow of warm, low dew point air or other suitable gas that is passed through the material bed. The air is supplied to the hopper via several flow paths extending from an inlet 16, which, in the preferred embodiment, is supplied with pressurized air from a compressed air supply (not shown). In practice, the inlet 16 may be connected to a manufacturing facility's existing compressed air system for powering pneumatic equipment. Such compressed air systems often include a refrigerant type dryer which provides partially dried air having a dew point of +40° F. to +50° F., which is advantageous but not necessary to the practice of the invention. One or more conventional filters 18 may be installed after a conventional valve 17 leading from the inlet 16, to remove undesirable contaminants from the compressed air stream.

A portion of the compressed air from the inlet 16 is supplied, via a first flow path FP1 to a first sub-system SS1 that includes a dryer MD and a heater EH'. In the preferred embodiment, the dryer is a membrane dryer. Low dew point (e.g., −10° F. to −20° F.) air output from the membrane dryer is passed to the heater EH' via a pressure regulator 21 and a flow-regulating orifice 22 to provide a desired pressure and air flow rate through the dryer. Typically, expansion through the orifice 22 provides air at atmospheric pressure with a dew point of, e.g., −40° F. or lower. The heater EH' may have any suitable heat source, an electric heater being shown in the illustrative arrangement. The warmed, low dew point air from the electric heater is fed to a first portion of the drying hopper DH, being introduced into the material bed at a lower portion of the hopper via a diffuser 36, such as a length of perforated pipe. The air flows upwardly through the hopper and permeates the particulate bed, drawing off moisture from the bed material.

Table I provides estimated specifications for several models of commercial apparatus having different material throughput rates. It also lists several common plastics that can be dried using the present invention and their preferred drying temperatures, although it will be appreciated that this list is merely exemplary.

TABLE I

| MODEL | MATERIAL FLOW (LBS/HR) | Estimated Un-Dried Compressed air flow (SCFM) | Estimated Dried Compressed air flow (SCFM) | Estimated Total Compressed air flow (SCFM) | Estimated Total Element (Std. Heat) 300° F. (KW) |
|---|---|---|---|---|---|
| N-5 | 5 | 0.5 | 1.3 | 2.5 | 0.5 |
| N-15 | 15 | 1.6 | 2.4 | 5 | 1.4 |
| N-35 | 35 | 3.9 | 6.0 | 12 | 3.1 |
| N-75 | 75 | 8.3 | 12.8 | 25 | 6.7 |
| N-120 | 120 | 13.3 | 20.5 | 40 | 10 |

Common plastics that can be dried and their nominal drying temperatures:
Nylon: 160° F.
ABS: 108° F.
Acrylic: 190° F.
Polycarbonate: 250° F.
TPO: 190° F.
PET: 325° F.

A second flow path FP2 for compressed air from the inlet 16 extends through a pressure regulator 20 to a second sub-system SS2 that includes a mixing device 30 and a heater EH. The mixing device is preferably an airflow amplifier, such as the amplifiers sold by Nortel Machinery, Inc. of Buffalo, N.Y., although other types of mixing devices, such as venturis and ejectors, for example, can be used. compressed air supplied to a first inlet 32 of the mixing device induces a flow of recirculating air from an upper portion of the drying hopper, preferably via a filter 26, to a second inlet 31 of the mixing device. The mixing device mixes air supplied thereto at the inlets 31 and 32. Mixed gases at an outlet 33 of the mixing device are supplied to the drying hopper via heater EH (an electric heater in the illustrative arrangement). The heated mixture of gases enters the hopper DH via a diffuser 34, such as a pipe with a screened outlet, and is supplied to the hopper at a second portion of the hopper above the diffuser 36.

The mixing device combines the two inlet air streams at a predetermined volumetric ratio, which can be adjusted. A ratio of about 5-to-1 recirculated-to-compressed air volumes has been found to be satisfactory for common plastic drying applications. Of course, an appropriate ratio for any given application may readily be determined by simple trial and error.

The use of drying air recirculation is advantageous in that it permits a reduction in the amount of compressed air required for the drying process. It also allows for the use of a smaller membrane dryer.

In the preferred embodiment, most of the drying may be effected in the upper portion of the hopper by the drying air from the diffuser 34 supplemented by the drying air from the diffuser 36. The remainder of the drying is effected near the bottom of the particulate bed by the air from the diffuser 36. It has been found that this system configuration provides excellent drying performance, especially in summer conditions when ambient air supplied to the compressed air system in a manufacturing plant tends to be more humid. A relief valve 37 connected to an air vent 39 prevents undesired pressure build up in the drying hopper.

It will be noted that a number of temperature and pressure indicators and controls appearing in the drawing have not been specifically discussed, as their purpose and function will be readily understood by those skilled in the art. For example, the pressure switch PS can shut off the membrane dryer when the pressure of the compressed air from the inlet 16 is below an appropriate value.

While a preferred embodiment of the invention has been shown and described, it will be appreciated by those skilled in the art that various modifications can be made in keeping with the basic principles of the invention. For example, instead of a single membrane dryer, a plurality of membrane dryers may used, as indicated by dashed lines in the drawing. Also, instead of supplying compressed air directly to inlet 32 of the air mixer, the output of the membrane dryer can be split, so that the flow path FP2 to the inlet 32 of the air mixer extends from the membrane dryer. Further, provisions may be included to control the amount of drying more precisely, such as by providing a detector to monitor the humidity of drying air that exits the hopper and a pressure controller to throttle the air pressure to the membrane dryer depending upon the detected humidity to control the dew point. As indicated earlier, although membrane dryers are preferred for use in the invention, other types of dryers may be employed in the system of the invention. While one of the advantages of the invention is that it avoids the drawbacks of desiccant dryers, there may be some instances in which it is possible and appropriate to use a desiccant type dryer in the sub-system SS1 in conjunction with the sub-system SS2.

What is claimed is:

1. A system for drying solid bulk material in a hopper, comprising:

an inlet for compressed gas;

a first sub-system, including a membrane dryer and a heater, connected to said inlet, the first sub-system supplying dried heated gas to a first portion of the hopper; and a second sub-system, including a mixing device connected to said inlet along a gas flow path that bypasses said membrane dryer, and a heater, the mixing device using gas from said inlet to induce the withdrawal of gas from the hopper and to mix the withdrawn gas with gas supplied from said inlet, and the mixed gases being heated and supplied to a second portion of the hopper.

2. A system according to claim 1, wherein the inlet is connected to a source of compressed gas.

3. A system according to claim 1, wherein the gas supplied to the first portion of the hopper is supplied via a first diffuser at a lower portion of the hopper, and the gas supplied to the second portion of the hopper is supplied via a second diffuser above the first diffuser.

4. A system according to claim 1, wherein the hopper is constructed to provide a flow of solid bulk material that enters the hopper from the top of the hopper and that exits the hopper from the bottom of the hopper.

5. A method of drying material in a chamber, that comprises:

supplying a first portion of gas from a source of compressed gas to a membrane dryer;

supplying gas dried by the membrane dryer, and heated, to a first portion of the chamber;

supplying a second portion of gas from said source, independently of said membrane dryer, to a gas mixing device;

withdrawing gas from the chamber and using the mixing device to mix the withdrawn gas with the second portion of gas; and supplying the mixed gases to a second portion of the chamber.

6. A method according to claim 5, wherein the chamber is a hopper through which material to be dried is passed, and the first portion of the chamber is below the second portion of the chamber.

7. A method according to claim 5, wherein the amount of gas withdrawn from the chamber is several times the amount of the second portion of gas supplied to the mixing device.

8. A method according to claim 5, wherein the mixing device uses the second portion of gas to induce the withdrawal of gas from the chamber.

9. A method according to claim 5, wherein the amount of mixed gases supplied to the second portion of the chamber is several times the amount of gas supplied to the first portion of the chamber.

10. Apparatus for drying particulate material in a drying hopper, comprising:

an inlet for receiving compressed air;

a first flow path connected to the inlet, that includes a membrane dryer and that provides compressed air from the inlet to the membrane dryer;

a first heater that receives and heats dried compressed air from the membrane dryer;

a first diffuser in the hopper that receives dried heated air from the first heater;

a second flow path connected to the inlet separately from the membrane dryer and that provides compressed air from the inlet to a mixing device that withdraws air from an upper portion of the hopper and mixes the compressed air provided to the mixing device with air withdrawn from the hopper;

a second heater that receives and heats the mixed air from the mixing device; and a second diffuser in the hopper, above the first diffuser, that receives heated mixed air from the second heater.

* * * * *